US007097741B2

(12) United States Patent
Watanabe et al.

(10) Patent No.: US 7,097,741 B2
(45) Date of Patent: Aug. 29, 2006

(54) BELT FOR SHOE PRESS

(75) Inventors: Atsuo Watanabe, Hirakata (JP); Takahisa Hikida, Hirakata (JP); Atsushi Watanabe, Hirakata (JP)

(73) Assignee: Yamauchi Corporation, Hirakata (JP)

( * ) Notice: Subject to any disclaimer, the term of this patent is extended or adjusted under 35 U.S.C. 154(b) by 0 days.

(21) Appl. No.: 10/473,386

(22) PCT Filed: Apr. 8, 2002

(86) PCT No.: PCT/JP02/03510

§ 371 (c)(1),
(2), (4) Date: Sep. 30, 2003

(87) PCT Pub. No.: WO02/090649

PCT Pub. Date: Nov. 14, 2002

(65) Prior Publication Data

US 2004/0112561 A1 Jun. 17, 2004

(30) Foreign Application Priority Data

Apr. 27, 2001 (JP) ..... 2001-132232

(51) Int. Cl.

| | |
|---|---|
| ***D21F 3/02*** | (2006.01) |
| ***B32B 27/04*** | (2006.01) |
| ***B32B 27/12*** | (2006.01) |
| ***B30B 5/04*** | (2006.01) |

(52) U.S. Cl. ..... 162/358.4; 162/358.3; 162/901; 442/65; 428/167; 428/339; 100/153

(58) Field of Classification Search ..... 162/116, 162/117, 205–207, 306, 348, 358.3, 358.4, 162/361, 901; 428/163, 167, 156, 157, 332, 428/339; 442/59, 181, 64–73, 104, 105, 442/164; 100/151, 153
See application file for complete search history.

(56) References Cited

U.S. PATENT DOCUMENTS

| | | | | |
|---|---|---|---|---|
| 4,559,258 | A | | 12/1985 | Kiuchi |
| 6,030,503 | A | * | 2/2000 | Matuschczyk ..... 162/358.4 |

FOREIGN PATENT DOCUMENTS

| | | | |
|---|---|---|---|
| DE | 44 01 580 | * | 6/1994 |
| DE | 44 45 472 | * | 6/1996 |
| EP | 0 978 588 | A2 | 2/2000 |
| JP | 59-54598 | U | 4/1984 |
| JP | 60-224893 | A | 11/1985 |
| JP | 4-119191 | * | 4/1992 |

(Continued)

*Primary Examiner*—Eric Hug
(74) *Attorney, Agent, or Firm*—Birch, Stewart, Kolasch & Birch, LLP

(57) ABSTRACT

A shoe press belt capable of preventing the occurrence and growth of cracks therein and is used in a paper-making press apparatus containing a press roll, a belt, and a pressure shoe for pressing a material web, wherein the shoe press belt includes a reinforcing layer, a first elastic material layer, and a second elastic material layer. A plurality of grooves are formed at an exterior peripheral surface region of the first elastic material layer. The bottom of the grooves at an axial end region of the belt corresponding to at least one of an end-proximate region in an axial direction of the pressure shoe and an end-proximate region in an axial direction of the press roll extends toward the reinforcing layer relative to the bottom of the grooves at a region other than the end region.

8 Claims, 11 Drawing Sheets

FOREIGN PATENT DOCUMENTS

| | | | | |
|---|---|---|---|---|
| JP | 4-119191 | A | | 4/1992 |
| JP | 8-13373 | | * | 1/1996 |
| JP | 8-13373 | A | | 1/1996 |
| JP | 10-510594 | A | | 10/1998 |
| JP | 11-12975 | A | | 1/1999 |
| WO | WO 87/02080 | A1 | | 4/1987 |
| WO | WO 96/12065 | | * | 4/1996 |
| WO | WO 96/12065 | A1 | | 4/1996 |

* cited by examiner

BELT FOR SHOE PRESS

This application is the national phase under 35 U.S.C. § 371 of PCT International Application No. PCT/JP02/03510 which has an International filing date of Apr. 8, 2002, which designated the United States of America.

TECHNICAL FIELD

The present invention relates to a shoe press belt used in a paper-making apparatus.

BACKGROUND ART

Recently, the so-called shoe press for dewatering a wet web by pressing one surface of the wet web disposed on a felt travelling fast with a press roll and pressuring the other surface with a pressure shoe with an endless belt interposed therebetween is widely used in a press part of a paper-making process, in order to increase an efficiency in dewatering the wet web. The shoe press has conventionally used a belt formed in an endless manner with a reinforcing substrate integrated with an elastic material such as thermosetting polyurethane.

As shown in FIG. 11, a typical structure of the shoe press belt has elastic materials 102, 103 formed on the opposite surfaces of a base fabric 101, and also has a surface provided with a groove 104 in order to improve the dewatering ability.

In the shoe press, severe flex and pressure repeatedly applied on the belt between the press roll and the pressure shoe may cause cracks from the exterior peripheral surface of the belt in course of using the belt. Once the cracks occur, they grow bigger with the use of the belt. The growing cracks cause lubricating oil between the interior peripheral surface of the belt and the pressure shoe to leak outside to adversely affect the web, or cause delamination of the belt.

To solve the problem described above, Japanese Patent Laying-Open No. 11-12975 discloses a shoe press belt where a concave groove at an outer region of a width of a belt has a depth shallower than a concave groove at an inner region of the width in order to improve the crack-resistance in the vicinity of the shoe edge portion. However, even though the groove in the vicinity of the shoe edge portion has a depth shallower than the groove at the inner region of the width, the crack-resistance cannot be improved and cracks may be caused or grown.

SUMMARY OF THE INVENTION

The present invention is made to solve the problem described above and thus an object of the present invention is to provide a shoe press belt in which cracks are less likely to occur, and cracks, if any, do not grow in the belt.

In accordance with the present invention, a shoe press belt for use in a paper-making press apparatus including a press roll, a belt opposed to the press roll, and a pressure-shoe positioned inside the belt for pressing the belt against the press roll, the paper-making press apparatus allowing a material web to be inserted between the belt and the press roll for pressing the material web. The shoe press belt includes a reinforcing layer having an elastic material impregnated in an endless reinforcing substrate, a first elastic material layer positioned on an exterior peripheral surface side of the reinforcing layer and integrated with the elastic material impregnated in the reinforcing substrate, and a second elastic material layer positioned on an interior peripheral surface side of the reinforcing layer and integrated with the elastic material impregnated in the reinforcing substrate. A number of grooves are formed along a moving direction of the belt on an exterior peripheral surface region of the first elastic material layer. A bottom of the groove at an axial end region of the belt corresponding to at least one of an end-proximate region in an axial direction of the pressure shoe and an end-proximate region in an axial direction of the press roll is protruding toward the reinforcing layer relative to a bottom of a groove at a region excluding the axial end region.

The shoe press belt in accordance with the present invention is characterized in that the bottom of the groove at the axial end region resides in the reinforcing layer. The shoe press belt in accordance with the present invention is characterized in that the bottom of the groove at the axial end region is present between a position 0.3 mm away from an exterior peripheral surface of the reinforcing layer toward the first elastic material layer and a position 0.3 mm away from the exterior peripheral surface of the reinforcing layer toward the reinforcing layer.

The shoe press belt in accordance with the present invention is characterized in that the bottom of the groove at the axial end region has a U-shaped cross section in a belt width direction and is processed to have a curve or an obtuse angle. The shoe press belt in accordance with the present invention is characterized in that the reinforcing substrate includes a multi-woven fabric.

In accordance with the present invention, the shoe press belt includes a reinforcing layer having an elastic material impregnated in a reinforcing substrate, a first elastic material layer positioned on an exterior peripheral surface side of the reinforcing layer, and a second elastic material layer positioned on an interior peripheral surface side of the reinforcing layer, wherein a number of grooves are formed along a belt moving direction on an exterior peripheral surface region of the first elastic material layer, characterized in that a bottom of a groove at an axial end region of the belt corresponding to at least one of an end-proximate region in an axial direction of the pressure shoe and an end-proximate region in an axial direction of the press roll is protruding toward the reinforcing layer relative to a bottom of a groove at a region excluding the axial end region.

The inventors of the present invention have found that the cracks caused from the exterior peripheral surface of the belt tend to be concentrated on a particular portion of the belt., More specifically, complex stresses such as flex or torsion are concentrated on the belt at a region corresponding to the proximity of the end portion in the axial direction of the pressure shoe or a region corresponding to the proximity of the end portion in the axial direction of the press roll. Cracks are likely to occur from the corner portion of the bottom of the groove corresponding to this part.

A bottom of the groove at an axial end region of the belt corresponding to at least one of an end-proximate region in an axial direction of the pressure shoe and an end-proximate region in an axial direction of the press roll is protruding toward the reinforcing layer relative to a bottom of the groove at a region excluding the axial end region, so that a distance from the bottom of the groove to the reinforcing layer is reduced. Since the distance from the bottom of the groove to the reinforcing layer is reduced at the axial end region, the first elastic material layer is reduced in thickness and becomes more flexible, thereby preventing the occurrence of cracks. Furthermore, even if cracks occur from the bottom of the groove, the reinforcing layer can block the growth of the cracks because of the short distance between the bottom of the groove and the reinforcing layer.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
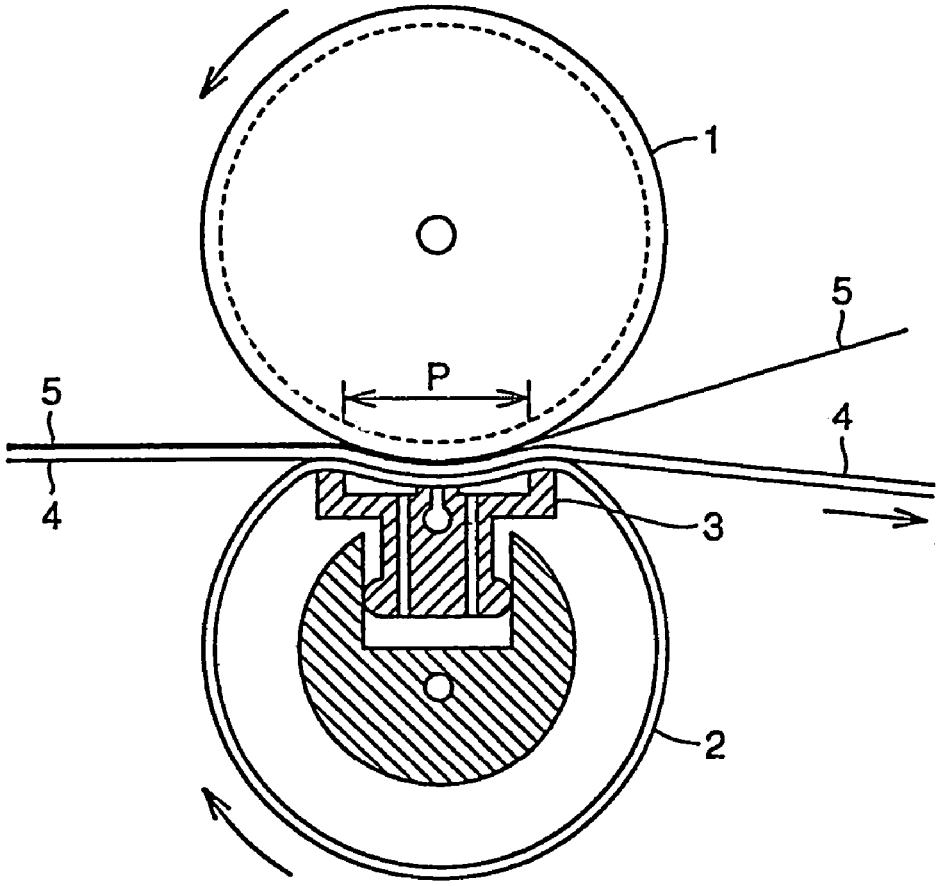
FIG. 1 is a view illustrating a shoe press apparatus.

FIG. 1 shows an exemplary shoe press apparatus for use in a press process of a paper machine. In FIG. 1, the shoe press apparatus includes a press roll 1, a belt 2 opposed to press roll 1, and a pressure shoe 3 positioned inside belt 2 for pressing belt 2 toward press roll 1. Lubricating oil is supplied between belt 2 and pressure shoe 3 so that belt 2 can slide on pressure shoe 3. A wet web as a material web 5 placed on a felt 4 is inserted between belt 2 and press roll 1. The exterior peripheral surface of belt 2 is in direct contact with felt 4. Belt 2 slidably moves on pressure shoe 3 with friction with felt 4. Pressure shoe 3 is pressed from the interior peripheral surface side of belt 2 toward press roll 1 at a prescribed pressure. Material web 5 is pressed with this pressing force to be dewatered. The surface of pressure shoe 3 has a concave shape corresponding to the surface of press roll 1. A pressure dewatering portion P having a large width is therefore formed between press roll 1 and pressure shoe 3.

Figure 2:
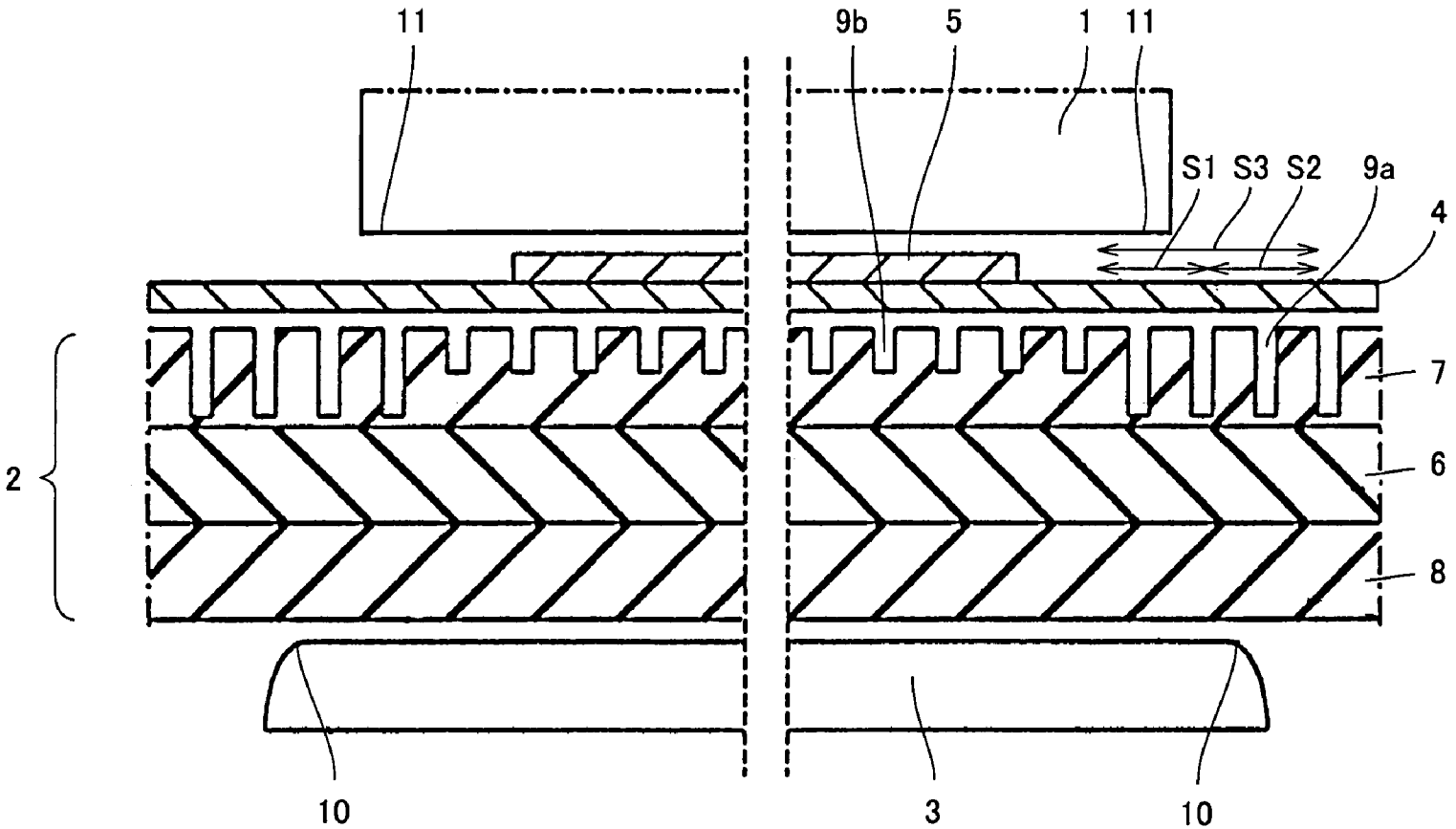
FIG. 2 is a cross sectional view of a shoe press belt in accordance with the present invention.

FIG. 2 shows a cross sectional view of a main part as seen from a moving direction of the shoe press apparatus using shoe press belt 2 in accordance with the present invention. Belt 2 is constituted with a reinforcing layer 6 having an elastic material impregnated in an endless reinforcing substrate, a first elastic material layer 7 positioned on the exterior peripheral surface side of reinforcing layer 6 and integrated with the elastic material impregnated in the reinforcing substrate of reinforcing layer 6, and a second elastic material layer 8 positioned on the interior peripheral surface side of reinforcing layer 6 and integrated with the elastic material impregnated in the reinforcing substrate of reinforcing layer 6. A fabric formed of organic fibers such as polyamide, polyester is used as the reinforcing substrate constituting reinforcing layer 6. Belt 2 as a whole is integrally formed of an elastic material such as thermosetting polyurethane and is structured to have the reinforcing substrate embedded in belt 2.

FIG. 2 shows an axial end region S3 including an end-proximate region S2 in the axial direction of pressure shoe 3 and an end-proximate region S1 in the axial direction of press roll 1. In axial end region S3, a bottom of a groove 9*a* is protruding toward reinforcing layer 6 relative to a bottom of a groove 9*b* at the region excluding axial end region S3.

It is noted that although FIG. 2 shows that end-proximate region S2 in the axial direction of pressure shoe 3 is adjacent to end-proximate region S1 in the axial direction of press roll 1, the present invention is not limited to such an adjacent state.

While axial end region S3 is preferably configured to include both end-proximate region S2 in the axial direction of pressure shoe 3 and end-proximate region S1 in the axial direction of press roll 1 as shown in FIG. 2, it may be configured to include either one of them.

End-proximate region S2 in the axial direction of pressure shoe 3 may extend from an axial end portion 10 of pressure shoe 3 to each of the belt inner side and the belt outer side by 300 mm. End-proximate region S1 in the axial direction of press roll 1 may extend from an axial end portion 11 of press roll 1 to each of the belt inner side and the belt outer side by 300 mm.

Figure 3:
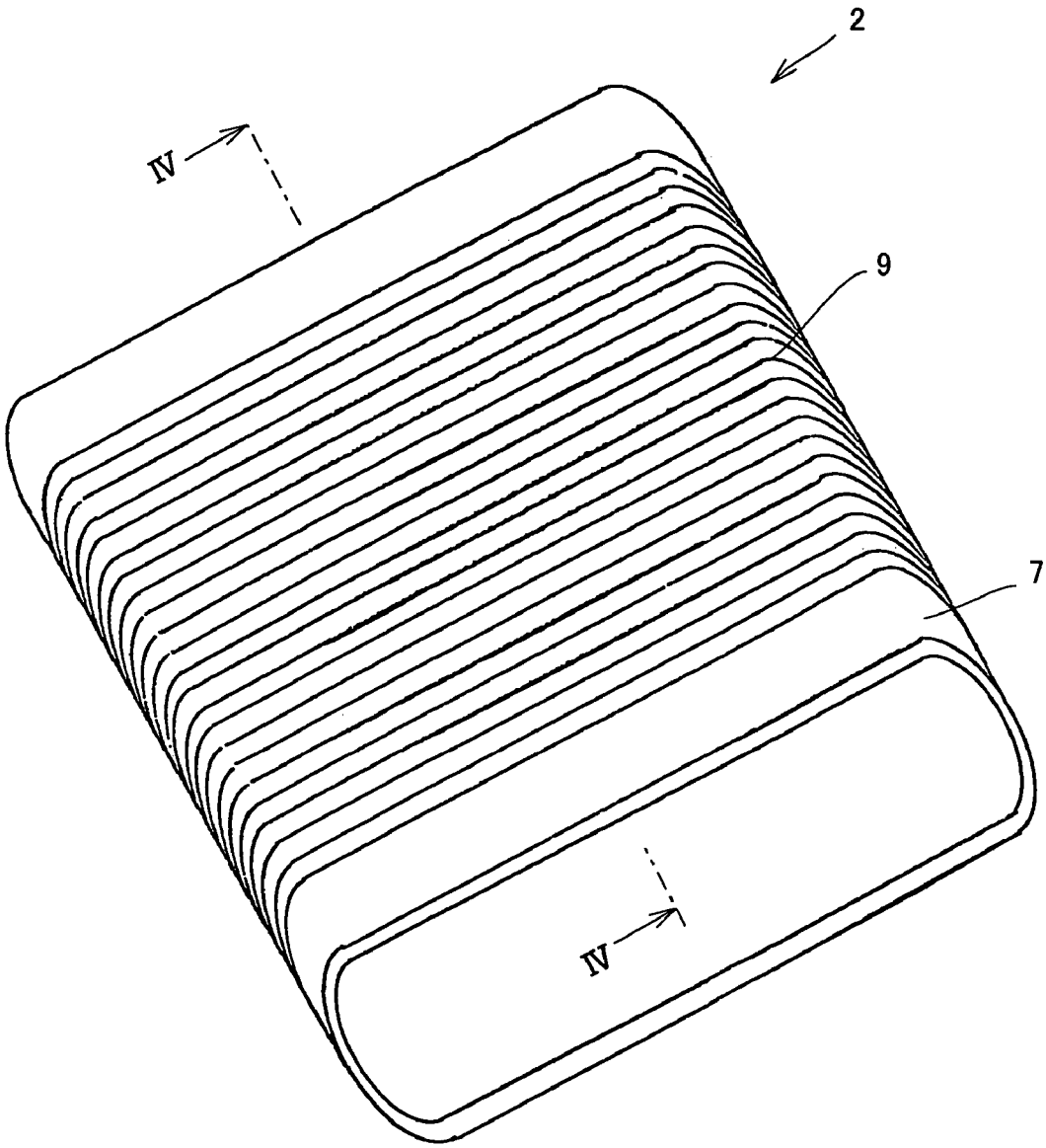
FIG. 3 is a perspective view schematically illustrating the shoe press belt in accordance with the present invention.

FIG. 3 is a perspective view schematically showing belt 2. As shown in FIG. 3, a number of grooves 9 are formed along the moving direction of belt 2 on the exterior peripheral surface of belt 2, that is, the exterior peripheral surface of first elastic material layer 7. By way of illustration, belt 2 may be sized to have a perimeter of 4.9 m and a width of 10 m and may have ten grooves 9 per inch each having a width of 1.0 mm, on the exterior peripheral surface.

Figure 4:
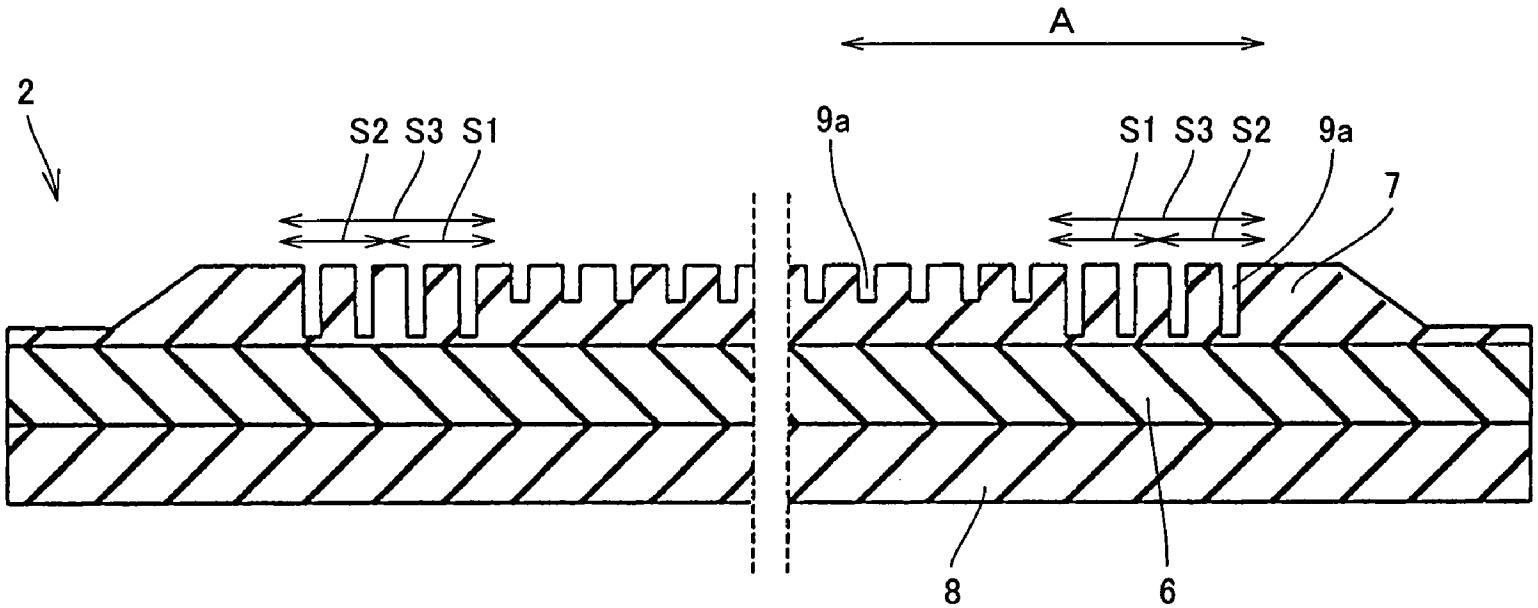
FIG. 4 is a schematic cross sectional view taken along IV—IV in FIG. 3.
Figure 5:
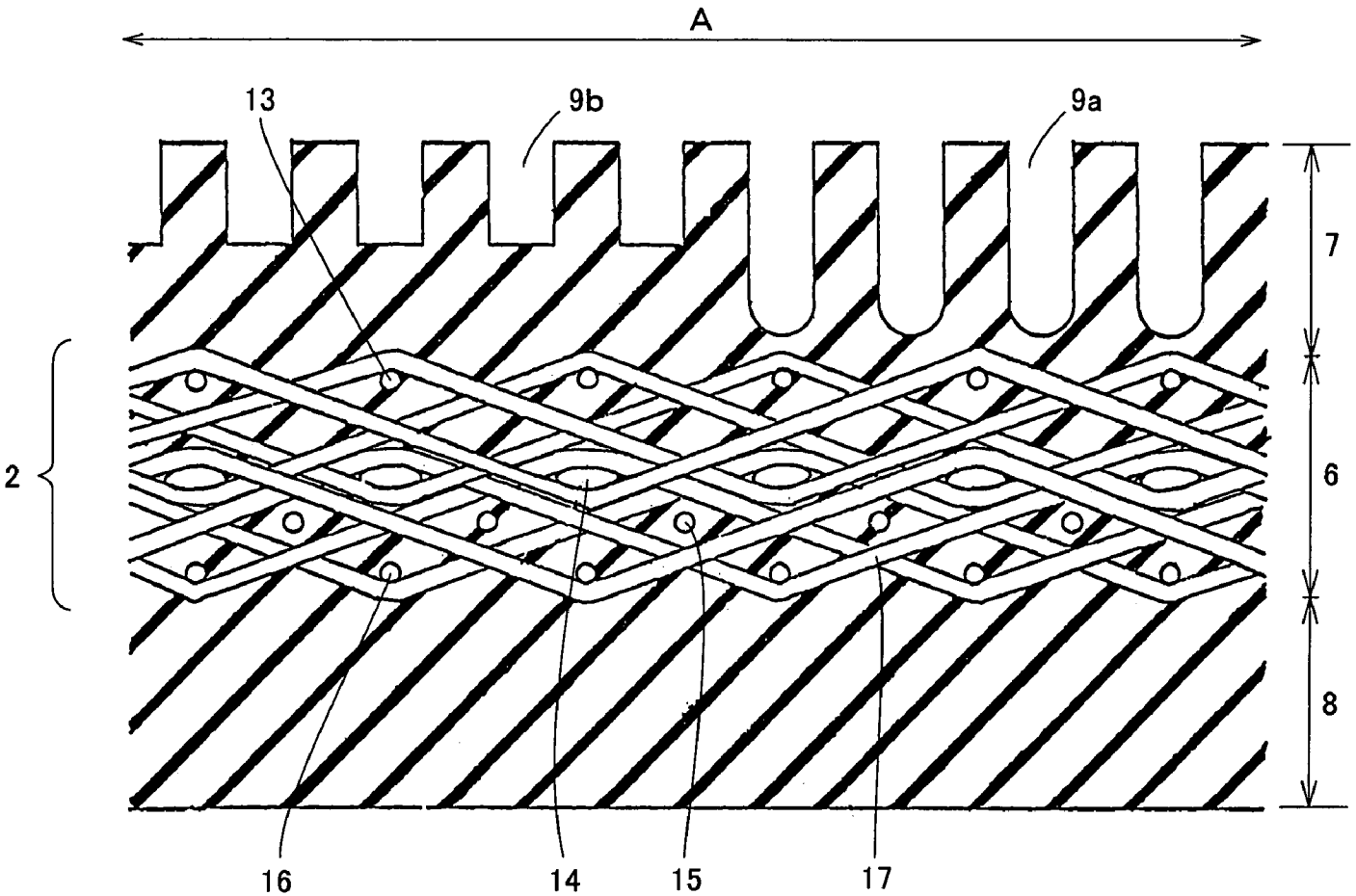
FIG. 5 is an enlarged partial cross sectional view of the shoe press belt in accordance with the present invention.

FIG. 4 is a schematic cross sectional view cut along IV—IV of belt 2 shown in FIG. 3. FIG. 5 is an enlarged view of a part corresponding to a width direction A of belt 2 in FIG. 4.

As shown in FIGS. 2, 4 and 5, in groove 9 of belt 2, the bottom of groove 9*a* positioned at axial end region S3 is formed to be deeper than the bottom of groove 9*b* positioned at the region excluding axial end region S3. In other words, the bottom of groove 9*a* positioned at axial end region S3 is formed to protrude toward reinforcing layer 6 relative to the bottom of groove 9*b* at the region excluding axial end region S3.

In the shoe press apparatus as shown in FIG. 1, cracks are likely to occur on the exterior peripheral surface of belt 2 at a region S2 corresponding to the proximity of axial end portion 10 of pressure shoe 3 or at a region S1 corresponding to the proximity of axial end portion 11 of press roll 1. Then, the bottom of groove 9a positioned at the portion where cracks are likely to occur is formed to protrude toward reinforcing layer 6 relative to the bottom of the other groove 9*b*, so that the distance from the bottom of groove 9*a* to reinforcing layer 6 is reduced at axial end region S3. Therefore, the first elastic material layer at this portion is reduced in thickness and becomes flexible, thereby preventing cracks. Even if cracks occur from the bottom of groove 9*a*, reinforcing layer 6 can block the growth of the cracks because the distance from the bottom of groove 9*a* to reinforcing layer 6 is short.

Figure 6:
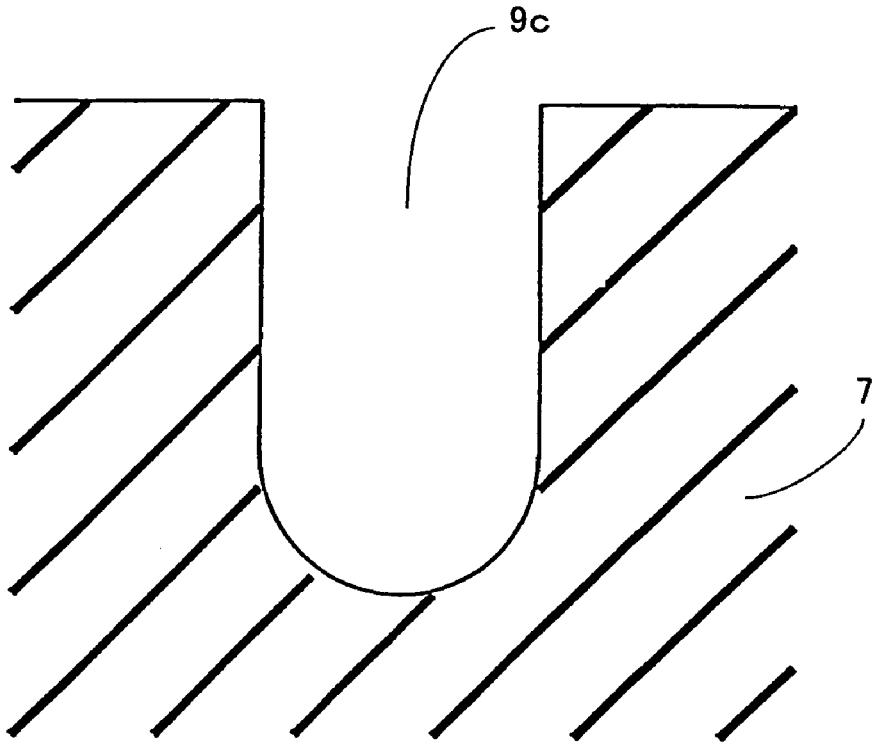
FIG. 6 is an enlarged cross sectional view of a groove of the shoe press belt in accordance with the present invention.
Figure 7:
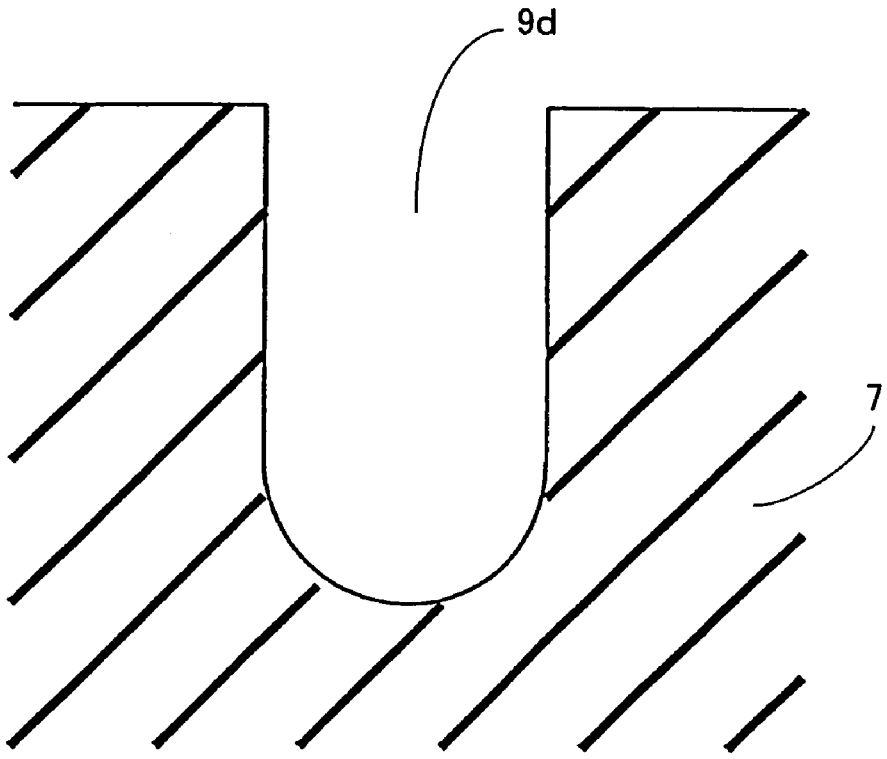
FIG. 7 is an enlarged cross sectional view of a groove of the shoe press belt in accordance with the present invention.

FIGS. 6 and 7 show as a modification a preferable shape of groove 9*a* positioned at axial end region S3. A groove 9*c* shown in FIG. 6 has a U-shaped cross section in the belt-width direction and is processed to have a curved base. A groove 9*d* shown in FIG. 7 has a U-shaped cross section in the belt-width direction and is processed to have a base at an obtuse angle. The shape of groove 9*a* as shown in FIG. 6 or 7 can effectively prevent the cracks from occurring from the bottom of the groove.

The reinforcing substrate preferably includes a number of pores in order to increase a degree of impregnation of an elastic material. For this reason, if a fabric is used as the reinforcing substrate, a multi-woven fabric is preferably used such as a triple-layer woven fabric or a quadruple-layer woven fabric.

In the example shown in FIG. 5, a quadruple-layer woven fabric 12 is used as the reinforcing substrate. By way of example, fabric 12 is made of warps in the belt moving direction of four layers: a polyester monofilament 13 having a diameter of 0.35 mm; a polyester multifilament 14 of 3000d; a polyester monofilament 15 having a diameter of 0.35 mm; and a nylon monofilament 16 having a diameter of 0.35 mm from the front surface side in the order, as well as wefts in the belt-width direction of a polyester monofilament 17 having a diameter of 0.40 mm. There are 68 warps per inch and 56 wefts per inch.

The use of multi-woven fabric 12 provides a high strength for the reinforcing substrate itself and also allows the elastic material to penetrate inwardly enough. Therefore, a sufficient anchoring effect can be achieved between the elastic material and the reinforcing substrate, which constitute belt 2, thereby preventing delamination. The elastic material is impregnated in the reinforcing substrate including multi-woven fabric 12 to form reinforcing layer 6, and first elastic material layer 7 positioned on the exterior peripheral surface side of reinforcing layer 6 is integrated with the elastic material impregnated in the reinforcing substrate, so that the reinforcing layer effectively blocks the growth of cracks. The elastic material is preferably integrated in a substantially continuous manner through first elastic material layer 7, reinforcing layer 6 and second elastic material layer 8. The elastic material may be formed by coating at a time or at several different times, or it may be formed by casting.

Referring to FIGS. 4 and 5, the method of manufacturing a shoe press belt in accordance with the present invention will be described. First, endless fabric 12 is turned inside out. Then, the elastic material is coated from the surface to be the back surface of fabric 12 to penetrate into about half the thickness of fabric 12 while second elastic material layer 8 is formed on fabric 12 to a prescribed thickness. This coating is performed at one time or at plural different times. The coated elastic material is cured at a prescribed temperature. Thereafter second elastic material layer 8 is cut/abraded to a prescribed thickness (for example 0.5 mm–2 mm).

Fabric 12 is then reversed, and the elastic material is coated from the front surface side to form first elastic material layer 7 to a prescribed thickness while filling the remaining pores in fabric 12. At this point, the elastic material coated from the opposite sides is penetrated enough in the pores to be substantially continuous in the reinforcing substrate. This coating may also be performed at a time or at different plural times.

The whole is heated at prescribed temperature to cure the elastic material. Thereafter first elastic material layer 7 is cut/abraded to a prescribed thickness (for example 0.5 mm–2 mm). Finally, groove 9 (9*a*, 9*b*) is formed on the front surface of first elastic material layer 7.

In the foregoing example, the elastic material is coated from the opposite sides of the reinforcing substrate. The elastic material may be cast from either surface side of the reinforcing substrate and may be passed through the reinforcing substrate, so that first elastic material layer 7 and second elastic material layer 8 can be formed in a single step.

Figure 8:
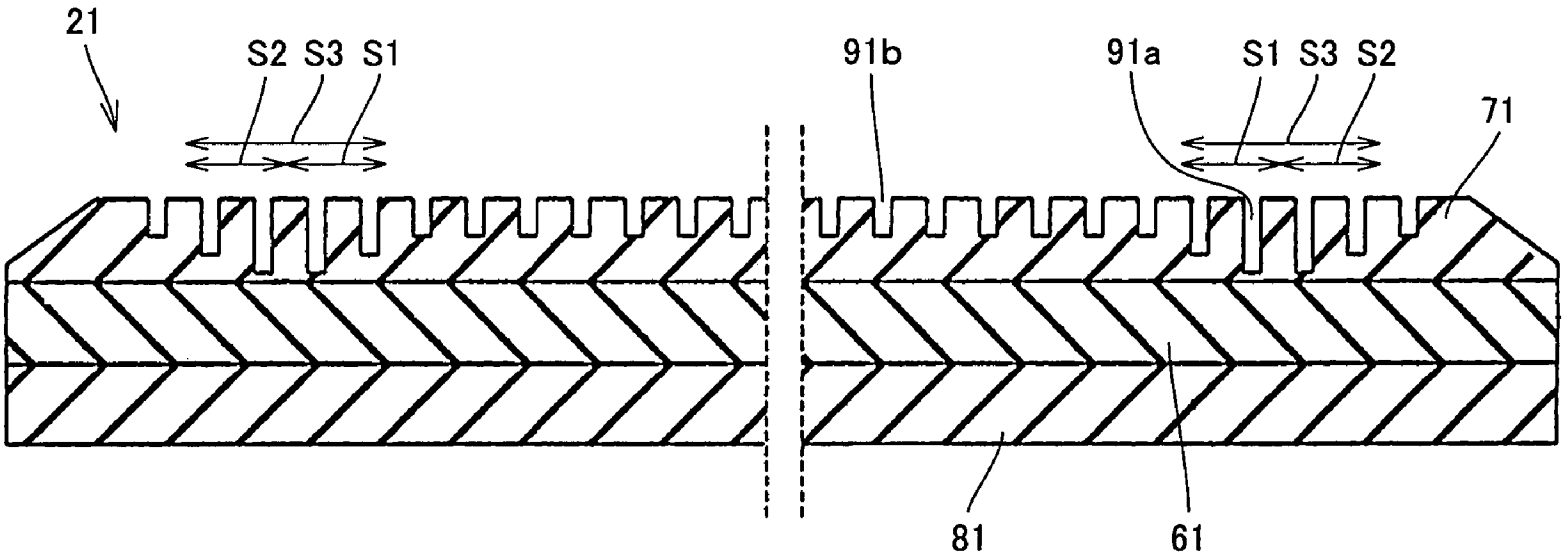
FIG. 8 is a schematic cross sectional view of the shoe press belt in accordance with the present invention.

FIG. 8 shows a modification of the shoe press belt in accordance with the present invention. A belt 21 shown in FIG. 8 is formed such that the depths of the grooves gradually increase from groove 91*b* positioned at the region excluding axial end region S3 toward groove 91*a* positioned at axial end region S3. It is noted that the depths of the bottoms of grooves 91*a* are reduced gradually from the center portion of axial end region S3 toward the outer side of the belt.

In this manner, the bottom of groove 91*a* positioned at axial end region S3 is formed to protrude toward reinforcing layer 61 relative to the bottom of groove 91*b* present at the other region.

Figure 9:
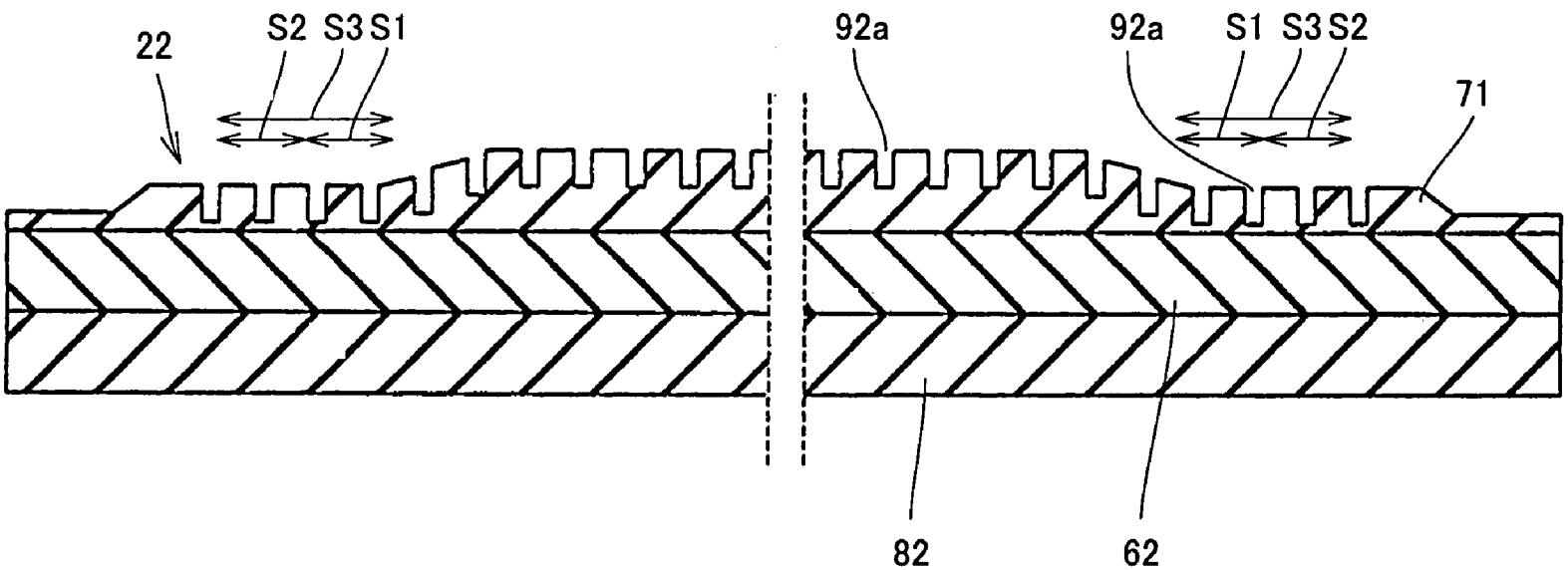
FIG. 9 is a schematic cross sectional view of the shoe press belt in accordance with the present invention.

FIG. 9 is a view illustrating another embodiment of the shoe press belt in accordance with the present invention. In a belt 22 shown in FIG. 9, the depths of the grooves are uniform over the entire belt. The thickness of a first elastic material layer 72, however, is formed to be gradually reduced from the region at the inside of the belt toward axial end region S3 at each of the opposite end portions. In this manner, the bottom of a groove 92*a* positioned at axial end region S3 is formed to protrude toward reinforcing layer 62 relative to the bottom of a groove 92*a* at the region excluding axial end region S3.

Figure 10:
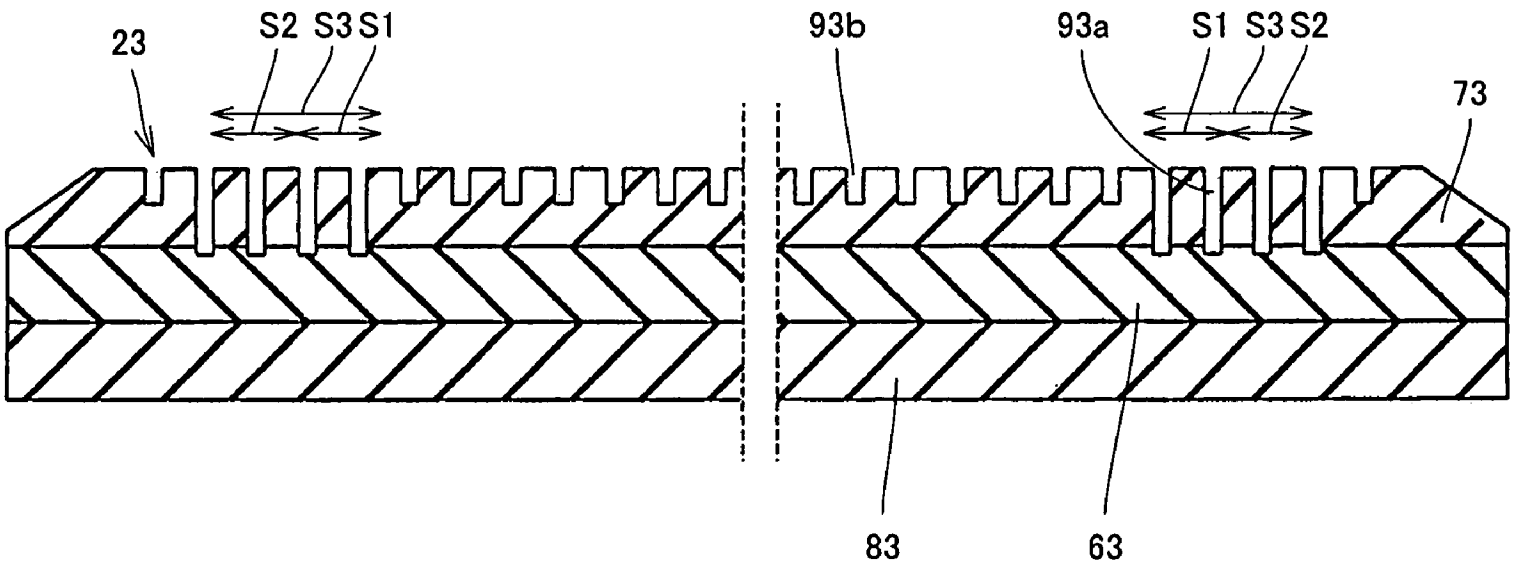
FIG. 10 is a schematic cross sectional view of the shoe press belt in accordance with the present invention.
Figure 11:
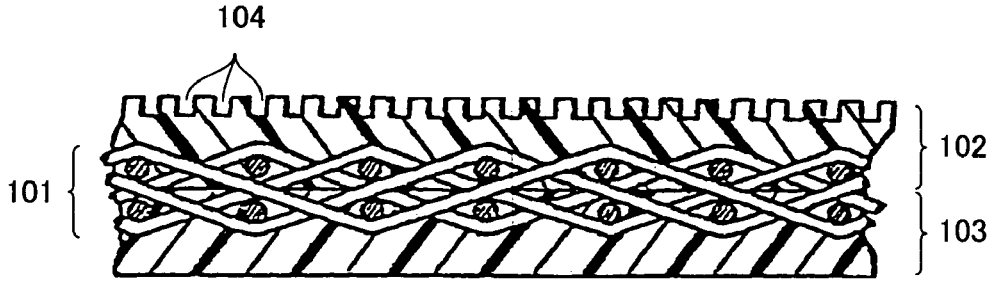
FIG.11 PRIOR ART
FIG. 11 is a schematic partial cross sectional view of a conventional shoe press belt.

FIG. 10 is a view illustrating a further embodiment of the shoe press belt in accordance with the present invention. In a belt 23 shown in FIG. 10, a bottom of a groove 93*a* positioned at axial end region S3 is protruding toward reinforcing layer 63 relative to a bottom of a groove 93*b* present at the region excluding axial end region S3. It is noted that the bottom of groove 93*a* positioned at axial end region S3 resides in reinforcing layer 63. Reinforcing layer 63 is formed with a fabric formed of an organic fiber such as polyamide or polyester into which an elastic material such as polyurethane is impregnated. In reinforcing layer 63, cracks hardly occur. Therefore, when the bottom of groove 93*a* resides in reinforcing layer 63, reinforcing layer 63 can effectively block the occurrence and growth of cracks.

In the present invention, the bottom of the groove positioned at axial end region S3 can be formed between a position 0.3 mm away from the exterior peripheral surface of the reinforcing layer to the first elastic material layer side and a position 0.3 mm away from the exterior peripheral surface of the reinforcing layer to the reinforcing layer side. Since the bottom of the groove positioned at axial end region S3 is at the position within 0.3 mm away from the exterior peripheral surface of the reinforcing layer to the first elastic material layer side, the elastic material layer at this position is reduced in thickness and becomes flexible and thus cracks hardly occur. Since the bottom of the groove positioned at axial end region S3 is at the position within 0.3 mm away from the exterior peripheral surface of the reinforcing layer to the reinforcing layer side, the reinforcing layer can block the occurrence and growth of cracks. It is noted that, in the configuration of the reinforcing substrate including a multi-woven fabric, even if the bottom of the groove at axial end region S3 resides in the reinforcing layer, the elastic material that is sufficiently impregnated in the reinforcing substrate can effectively maintain the strength of the reinforcing layer and can significantly reduce the occurrence of cracks.

It is noted that the embodiments disclosed herein is to be considered by way of illustration rather than by way of limitation in all aspects. The scope of the present invention is shown not by the forgoing description but by the claims and all equivalents to the claims and modifications within the claims are intended to be embraced.

INDUSTRIAL APPLICABILITY

A shoe press belt in the present invention employs a configuration in which a bottom of a groove at an end region including at least one of an end-proximate region in an axial direction of a pressure shoe and an end-proximate region in an axial direction of a press roll is protruding toward the reinforcing layer relative to a bottom of a groove at a region other than the end region. Therefore, since the distance from the bottom of the groove to the reinforcing layer is reduced at the end region, an elastic material layer at this portion is reduced in thickness and becomes flexible and cracks thus hardly occur. Even if a crack occurs from the bottom of the groove at the end region, the reinforcing layer can block the growth of the crack because of the short distance from the bottom of the groove to the reinforcing layer. When the groove positioned at the end region has its bottom positioned inside the reinforcing layer, the reinforcing layer can also block the occurrence and growth of cracks effectively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A shoe press belt for use in a paper-making press apparatus containing a press roll, a belt opposed to the press roll, and a pressure shoe positioned inside the belt for pressing the belt against said press roll, and a material web adapted to be inserted between said belt and said press roll for pressing the material web, the shoe press belt comprising:

a reinforcing layer having an elastic material impregnated in an endless reinforcing substrate;

a first elastic material layer positioned on an exterior peripheral surface side of the reinforcing layer and integrated with said elastic material impregnated in the reinforcing substrate; and a second elastic material layer positioned on an interior peripheral surface side of said reinforcing layer and integrated with said elastic material impregnated in the reinforcing substrate, wherein a plurality of grooves are formed in the belt, substantially parallel to the moving direction of the belt and on an exterior peripheral surface region of said first elastic material layer, and the bottom of the grooves provided at an axial end region of the belt, corresponding to at least one of an end-proximate region in the axial direction of said pressure shoe and at the end-proximate region in the axial direction of the press roll, extends toward the reinforcing layer to a greater degree relative to the bottom of the grooves in the belt provided in the region of the belt excluding said axial end region.

2. The shoe press belt according to claim 1, wherein the bottom of the groove at the axial end region extends into said reinforcing layer.

3. The shoe press belt according to claim 1, wherein the bottom of the groove at the axial end region is present between a position 0.3 mm away from an exterior peripheral surface of said reinforcing layer toward said first elastic material layer and a position 0.3 mm away from the exterior peripheral surface of said reinforcing layer toward said reinforcing layer.

4. The shoe press belt according to claim 1, wherein the bottom of the groove at the axial end region has a U-shaped cross sectional configuration in the belt width direction and is processed to have a curve or an obtuse angle.

5. The shoe press belt according to claim 1, wherein the reinforcing substrate includes a multi-woven fabric.

6. The shoe press belt of claim 1, wherein the depth of the grooves are substantially uniform.

7. The shoe press belt according to claim 1, wherein the plurality of grooves which are disposed at the axial end regions of the belt are of substantially uniform depth.

8. A paper-making press apparatus including a press roll, a shoe press belt opposed to the press roll, a pressure shoe positioned inside the shoe press belt for pressing the belt against a material web adapted to be inserted between said shoe press belt and said press roll, said shoe press belt comprising a reinforcing layer having an elastic material impregnated in an endless reinforcing substrate;

a first elastic material layer positioned on an exterior peripheral surface side of the reinforcing layer and integrated with said elastic material impregnated in the reinforcing substrate; and a second elastic material layer positioned on an interior peripheral surface side of said reinforcing layer and integrated with said elastic material impregnated in the reinforcing substrate, wherein a plurality of grooves are formed in the belt, substantially parallel to the moving direction of the belt and on an exterior peripheral surface region of said first elastic material layer, and the bottom of the grooves provided at an axial end region of the belt, corresponding to at least one of an end-proximate region in the axial direction of said pressure shoe and at the end-proximate region in the axial direction of the press roll, extends toward the reinforcing layer to a greater degree relative to the bottom of the grooves in the belt provided in the region of the belt excluding said axial end region.

* * * * *